US010312043B2

(12) United States Patent
Yu et al.

(10) Patent No.: US 10,312,043 B2
(45) Date of Patent: Jun. 4, 2019

(54) SEALED HIGH VOLTAGE DIRECT CURRENT RELAY

(71) Applicant: ZHEJIANG INNUOVO NEW ENERGY TECHNOLOGY CO., LTD., Dongyang, Zhejiang Province (CN)

(72) Inventors: Rongai Yu, Dongyang (CN); Wenrong Song, Dongyang (CN); Xiaobin Guo, Dongyang (CN); Haiyan Huang, Dongyang (CN); Peng Su, Dongyang (CN); Dejin Du, Dongyang (CN)

(73) Assignee: ZHEJIANG INNUOVO NEW ENERGY TECHNOLOGY CO., LTD., Dongyang (CN)

( * ) Notice: Subject to any disclaimer, the term of this patent is extended or adjusted under 35 U.S.C. 154(b) by 7 days.

(21) Appl. No.: 15/539,612

(22) PCT Filed: Jul. 7, 2016

(86) PCT No.: PCT/CN2016/089178
§ 371 (c)(1),
(2) Date: Jun. 23, 2017

(87) PCT Pub. No.: WO2017/088492
PCT Pub. Date: Jun. 1, 2017

(65) Prior Publication Data

US 2018/0025872 A1 Jan. 25, 2018

(30) Foreign Application Priority Data

May 27, 2016 (CN) ..... 2016 1 0359379

(51) Int. Cl.
*H01H 9/02* (2006.01)
*H01H 50/02* (2006.01)
(Continued)

(52) U.S. Cl.
CPC ..... *H01H 50/023* (2013.01); *H01H 50/36* (2013.01); *H01H 51/29* (2013.01); *H01H 50/546* (2013.01)

(58) Field of Classification Search
CPC ..... H01H 50/023; H01H 50/10; H01H 50/36; H01H 50/546; H01H 50/58; H01H 67/02; H01H 51/29
(Continued)

(56) References Cited

U.S. PATENT DOCUMENTS 2,324,301 A * 7/1943 Heintz ..... H01H 51/065 200/304
2,451,810 A * 10/1948 Cohen ..... H02P 9/24 200/16 R
(Continued)

FOREIGN PATENT DOCUMENTS

| | | | |
|---|---|---|---|
| CN | 103883455 | A | 6/2014 |
| CN | 105070592 | A | 11/2015 |
| JP | H05151870 | A | 6/1995 |

*Primary Examiner* — Shawki S Ismail
*Assistant Examiner* — Lisa N Homza
(74) *Attorney, Agent, or Firm* — Jiwen Chen

(57) ABSTRACT

The present invention discloses a sealed HVDC relay, comprising an insulating hood and a yoke plate which is extended upward to form a cylindrical fixing portion; the insulating hood has an overturned cup structure; a chamber for accommodating moving contacts and stationary contacts is formed by the yoke plate and the insulating hood together; a lower end of the insulating hood and the fixing portion of the yoke plate are fitted with each other by threads; and the portion fitted by threads between the lower end of the insulating hood and the fixing portion is sealed by adhesive pouring. In the present invention, with the insulating hood made of ceramics, the stiffness of the relay structure of the present invention is promised. The absence of a brazing process makes the relay of the present invention short in
(Continued)

manufacturing period and low in cost. With regard to the present invention, the sealing performance of the relay is promised by adhesive pouring, and a service voltage of the relay can be increased. In this way, the voltage of the relay of the present invention can reach 1000 V, thus improving the application performance of the present invention.

10 Claims, 3 Drawing Sheets

(51) Int. Cl.
*H01H 50/36* (2006.01)
*H01H 51/29* (2006.01)
*H01H 50/54* (2006.01)

(58) Field of Classification Search
USPC ..... 335/202
See application file for complete search history.

(56) References Cited

U.S. PATENT DOCUMENTS 2,843,701 A * 7/1958 Steward ..... H01H 51/28 218/142
3,001,046 A * 9/1961 Racz ..... H01H 51/28 200/248
3,017,474 A * 1/1962 Clarence ..... H01H 50/20 335/179
3,057,047 A * 10/1962 Zimmer ..... H01H 1/16 29/593
3,086,094 A * 4/1963 Ovshinsky ..... H01H 1/16 200/277
3,098,907 A * 7/1963 Reed ..... H01H 5/02 335/154
3,099,730 A * 7/1963 Tateishi ..... H01H 50/546 335/131
3,161,749 A * 12/1964 Perry ..... H01H 33/6664 200/275
3,190,985 A * 6/1965 Pearse ..... H01H 51/281 335/152
3,290,628 A * 12/1966 McGary ..... H01H 50/546 335/131
3,377,449 A * 4/1968 Marquis ..... H01H 50/62 200/504
3,560,898 A * 2/1971 Steinback ..... H01H 51/284 335/5
3,824,509 A * 7/1974 McGary ..... H01H 50/045 200/280
4,039,984 A * 8/1977 DeLucia ..... H01H 1/58 335/151
4,168,480 A * 9/1979 De Lucia ..... H01H 33/021 174/17 GF
4,382,241 A * 5/1983 Hehl ..... H01F 7/1607 335/153
4,512,627 A * 4/1985 Archer ..... G02B 6/3508 335/136
5,245,881 A * 9/1993 Rometsch ..... F02N 15/067 335/131
5,541,561 A * 7/1996 Grunert ..... H01H 9/42 335/132
5,892,194 A * 4/1999 Uotome ..... H01H 1/34 218/68
6,538,541 B1 * 3/2003 Kralik ..... H01H 51/2209 335/136
6,650,210 B1 * 11/2003 Raklyar ..... H01P 1/125 200/504
7,116,196 B1 * 10/2006 Hirabayashi ..... H01H 50/443 335/282
7,549,899 B2 * 6/2009 Imanishi ..... H01H 50/443 335/126
7,829,808 B2 * 11/2010 Bogdon ..... H01H 71/0214 200/293
7,830,231 B2 * 11/2010 Carlino ..... H01H 71/322 335/102
7,852,178 B2 12/2010 Bush et al.
8,138,440 B2 * 3/2012 Onufriyenko ..... H01H 73/045 218/154
8,143,979 B2 * 3/2012 Usami ..... H01R 4/06 335/127
8,305,169 B2 * 11/2012 Suzuki ..... F02N 11/087 335/126
8,492,916 B2 * 7/2013 Murata ..... F02N 11/087 290/38 R
8,749,331 B2 * 6/2014 Kashimura ..... H01H 33/182 335/126
8,836,456 B2 * 9/2014 Tachikawa ..... H01H 9/34 335/132
8,994,482 B2 * 3/2015 Yokoyama ..... H01H 50/02 335/131
2005/0062569 A1 * 3/2005 Kumar ..... H01H 71/7463 335/202
2005/0190024 A1 * 9/2005 McMahon ..... H01H 1/5855 335/126
2007/0241847 A1 * 10/2007 Yamamoto ..... H01H 50/305 335/196
2008/0283352 A1 * 11/2008 Purvines ..... F16D 27/112 192/84.1
2012/0098629 A1 * 4/2012 Weigt ..... H01H 51/065 335/126
2012/0139670 A1 * 6/2012 Yamagata ..... H01H 50/023 335/2
2013/0106544 A1 * 5/2013 Schmidt ..... H01H 51/06 335/202
2013/0257567 A1 * 10/2013 Takaya ..... H01H 9/443 335/133
2014/0062627 A1 * 3/2014 Naka ..... H01H 50/42 335/189
2014/0184366 A1 * 7/2014 Ito ..... H01H 50/54 335/189
2014/0253269 A1 * 9/2014 Yamauchi ..... H01H 49/00 335/202
2015/0022292 A1 * 1/2015 Tachikawa ..... H01H 50/54 335/131
2015/0022293 A1 * 1/2015 Naka ..... H01H 50/023 335/153
2015/0034600 A1 * 2/2015 Isozaki ..... H01H 9/443 218/148
2015/0054606 A1 * 2/2015 Naka ..... H01H 50/36 335/179
2015/0077202 A1 * 3/2015 Enomoto ..... H01H 1/54 335/171
2016/0254113 A1 * 9/2016 Nishimura ..... H01H 50/14 335/202
2016/0365209 A1 * 12/2016 Blackmon ..... H01H 50/041
2018/0025872 A1 * 1/2018 Yu ..... H01H 50/023 335/202
2018/0025873 A1 * 1/2018 Song ..... H01H 50/18 335/189
2018/0025874 A1 * 1/2018 Song ..... H01H 50/58 335/189

* cited by examiner

SEALED HIGH VOLTAGE DIRECT CURRENT RELAY

This is a U.S. national stage application of PCT Application No. PCT/CN2016/089178 under 35 U.S.C. 371, filed Jul. 7, 2016 in Chinese, claiming priority of Chinese Application No. 201610359379.4, filed May 27, 2016, all of which are hereby incorporated by reference.

TECHNICAL FIELD OF THE INVENTION

The present invention relates to a high voltage direct current (HVDC) relay, and in particular to a sealed HVDC relay which has been sealed.

BACKGROUND OF THE INVENTION

An HVDC relay comprises a frame and a yoke plate; a chamber for accommodating a stationary contact assembly and a moving contact assembly is formed by the frame and the yoke plate; the stationary contact assembly comprises a leading-out end and stationary contacts; the leading-out end is fixed with the frame and extended to an outer side of the frame, wherein the chamber is to be vacuumized inside and filled with inert gases. In the prior art, most frames are made of plastics or ceramics. Frames made of plastics will be provided with a sealing adhesive to seal the chamber, so as to promise the sealing performance of the chamber. The position where the plastic frame and the yoke plate contact and the position where the leading-out end and an outer side of the frame contact are sealed by the sealing adhesive. With regard to a frame made of ceramics, the stiffness of the product structure is promised by the ceramic itself, so as to ensure the sealing performance of the chamber.

The method in which a plastic frame is sealed by adhesive pouring has advantages such as short manufacturing period, low process requirements and low manufacturing cost. However, in long-term use, the plastic frame will be softened under the influence of temperature, the sealing adhesive will be burned and become yellow under the influence of temperature, and thus there is a risk that inert gases inside the chamber will leak. In addition, under the influence of temperature, the sealing adhesive will expand when heated and contract when cooled; and there will be a gap between the sealing adhesive and the leading-out end, thus leading to explosion.

With regard to a relay with a frame made of ceramics, due to the stiffness of the ceramic frame itself, the long-term use may cause only cracks on the ceramic frame without the risk of explosion. However, for a relays with a ceramic frame, the ceramic frame and the yoke plate as well as the leading-out end and the ceramic frame are to be brazed. Such a relay has relatively long manufacturing period and relatively high manufacturing cost.

SUMMARY OF THE INVENTION

An object of the present invention is to provide a sealed HVDC relay with better sealing performance, lower manufacturing cost and better application performance.

To achieve the purpose mentioned above, the present invention adopts the following technical solution. A sealed HVDC relay is provided, comprising an insulating hood and a yoke plate which is extended upward to form a cylindrical fixing portion; the insulating hood has an overturned cup structure; a chamber for accommodating moving contacts and stationary contacts is formed by the yoke plate and the insulating hood together; a lower end of the insulating hood and the fixing portion of the yoke plate are fitted with each other by threads; and the portion fitted by threads between the lower end of the insulating hood and the fixing portion is sealed by adhesive pouring. Wherein, the insulating hood is made of non-plastic insulating material, for example, ceramics, so that the insulating hood of the relay of the present invention will not be softened under the influence of temperature, and the risk that inert gases inside the chamber leak is thus avoided. In the present invention, the insulating hood and the yoke plate are fixed by threaded connection, and no brazing is required, thus leading to simpler process and lower cost. The portion fitted by threads between the insulating hood and the yoke plate is sealed by an adhesive, so as to prevent inert gases inside the chamber for accommodating the insulating hood and the yoke plate from leaking. External threads, or internal threads, can be formed at a lower end of the insulating hood, and a threaded structure corresponding to the insulating hood is formed on the yoke plate. Sealing by adhesive pouring can be performed in various ways. For example, an adhesive depositing groove can be formed on an outer side of the insulating hood, and sealing is performed by adhesive pouring into the adhesive depositing groove. Since the sealing adhesive is somewhat sticky, sealing can be performed by directly applying the adhesive to the portion fitted by threads.

Preferably, an external thread portion is formed at a lower end of the insulating hood, and an internal thread portion is formed at the fixing portion; the internal thread portion has a thread height less than that of the external thread portion; the insulating hood and the fixing portion of the yoke plate are fitted by threads so that external threads are exposed from the insulating hood at a position corresponding to the upper side of the fixing portion.

The thread height of the internal thread portion is the operational height of threaded fitting. After the external thread portion is fitted with the internal thread portion, external threads not fitted with the internal threads are exposed from the insulating hood at a position above the fixing portion of the yoke plate; and the sealing adhesive can enter the gap between the insulating hood and the yoke plate from the exposed external threads to perform sealing by adhesive pouring. Wherein, the portion fitted by threads between the insulating hood and the yoke plate is located on an outer side of the chamber for the convenience of sealing by adhesive pouring.

Preferably, an external thread portion is formed at a lower end of the insulating hood, and an internal thread portion is formed at the fixing portion; a magnetic circuit system is provided below the yoke plate, and the magnetic circuit system is arranged inside a cylindrical yoke cup having a wall extended upward above an upper end surface of the fixing portion of the yoke plate; a lower end surface of the insulating hood is resisted against the yoke plate; and a first adhesive pouring cavity is formed between the wall of the yoke cup and the insulating hood, and a sealing adhesive is filled inside the first adhesive pouring cavity.

In the present invention, the formation of an adhesive depositing groove by the yoke cup and the insulating hood facilitates sealing the relay of the present invention by adhesive pouring. Meanwhile, the adhesive depositing groove can be formed between the shell and the insulating hood of the relay. An adhesive is poured into the first adhesive pouring cavity, so that the sealing adhesive is limited inside the adhesive depositing groove without flowing around. The sealing adhesive, due to gravity, enters between the insulating hood and the yoke plate, which is more convenient for sealing by adhesive pouring.

Preferably, the insulating hood, the yoke plate and the yoke cup are all arranged inside a shell; the shell has a cylindrical structure; the top of the shell is fixed with an upper cover which is located above the insulating hood; a leading-out end comprises an upper section, a middle section and a lower section; stationary contacts are fixed with the lower section of the leading-out end, the middle section of the leading-out end is fixed with the insulating hood, and the upper section of the leading-out end passes through the insulating hood and the upper cover so as to be extended to an outer side of the upper cover; a first through hole for an upper end of the leading-out end to pass through is formed on the upper cover; an adhesive pouring hole is formed on the upper cover; and a second adhesive pouring cavity is formed between the upper cover and the insulating hood, and an sealing adhesive is filled inside the second adhesive pouring cavity.

An adhesive is poured into the second adhesive pouring cavity through an adhesive pouring hole formed by the upper cover, so as to seal the position where the leading-out end and the outer side of the insulating hood are connected. Wherein, the adhesive pouring hole is arranged on the upper cover; after the relay of the present invention is assembled, the leading-out end can be sealed by adhesive pouring without the concern that the sealing adhesive will flow out.

Preferably, the first adhesive pouring cavity and the second adhesive pouring cavity are communicated. Sealing by adhesive pouring can be performed after the relay of the present invention is assembled. When the adhesive is poured into the second adhesive pouring cavity, the sealing adhesive flows downward along an outer wall of the insulating hood, so that the adhesive is poured into the first adhesive pouring cavity. After the adhesive is poured into the first adhesive cavity, the gap between the wall of the shell and the outer wall of the insulating hood is gradually filled by the sealing adhesive; and the adhesive is finally poured into the second adhesive pouring cavity.

Preferably, a diameter of the first through hole is greater than an external diameter of the leading-out end; and a gap between the upper section of the leading-out end and the upper cover is the adhesive pouring hole. The adhesive pouring hole is closest to the leading-out end and also to the adhesive pouring cavity, so that the sealing adhesive enters the first adhesive pouring cavity conveniently, thus facilitating the adhesive pouring operation. When an adhesive is poured, the adhesive is filled between the first through hole and the leading-out end. The relay of the present invention is sealed by adhesive pouring when the sealing adhesive overflows the first through hole or when the sealing adhesive is located inside the first through hole.

Preferably, the wall of the yoke cup comprises an upper cup wall portion and a lower cup wall portion; an external diameter of the upper cup wall portion is greater than that of the lower cup wall portion; a lip structure is formed on a wall of the shell; and a lower edge of the upper cup wall portion is resisted against the lip structure. This arrangement can reduce the amount of the sealing adhesive used and also the time for adhesive pouring.

Preferably, an internal diameter of the upper cup wall portion of the yoke cup is greater than that of the lower cup wall portion; and the lower end surface of the yoke plate is resisted against the upper edge of the lower cup wall portion. This arrangement can reduce the amount of the sealing adhesive used and also the time for adhesive pouring.

Preferably, a plurality of positioning bosses extending downward are formed at an outer edge of the lower end surface of the upper cover; the plurality of positioning bosses are evenly arranged at intervals in an annular shape; and the positioning bosses are resisted against an inner side of the wall of the shell. Wherein, this arrangement facilitates the positioning and fixing of the upper cover and the shell.

Preferably, the insulating hood is made of ceramics; there are external threads on the lower side of the middle section of the leading-out end; a first threaded through hole fitted with the middle section of the leading-out end is formed on the top of the insulating hood; the first threaded through hole of the insulating hood and the external threads of the external thread portion are integrally shaped when the insulating hood is sintered. In the relay of the present invention, an insulating hood made of ceramics is used. A firm threaded structure between the insulating hood and the yoke plate is ensured through the stiffness of the insulating hood, and the sealing performance of the relay of the present invention is further promised. Wherein, a ceramic body of the insulating hood is obtained by molding; and by sintering the ceramic body, external threads are formed at a lower end of the wall of the insulating hood. This saves more cost than machining threads on the wall of the insulating hood made of ceramics. A bolt is inserted before a ceramic body of the insulating hood is made, so that the bolt is unscrewed from the top of the body after it is formed; and by sintering the ceramic body, a second through hole with a threaded structure can be formed on the insulating hood. This method has simpler process and lower cost than machining threads on a ceramic cover, and also has lower cost than brazing the leading-out end and the insulating hood. Wherein, as the leading-out end and the insulating hood are fixed by threaded connection, the connection strength between the leading-out end and the insulating hood can be enhanced. The thickness of the top of the insulating hood made of ceramics can be reduced while ensuring the connection strength between the leading-out end and the insulating hood, and the manufacturing cost of the present invention is thus reduced.

In the present invention, with the insulating hood made of ceramics, the stiffness of the relay structure of the present invention is promised. The absence of a brazing process makes the relay of the present invention short in manufacturing period and low in cost. With regard to the present invention, the sealing performance of the relay is promised by adhesive pouring, and a service voltage of the relay can be increased. In this way, the voltage of the relay of the present invention can reach 1000 V, thus improving the application performance of the present invention.

DETAILED DESCRIPTION OF THE INVENTION

Figure 1:
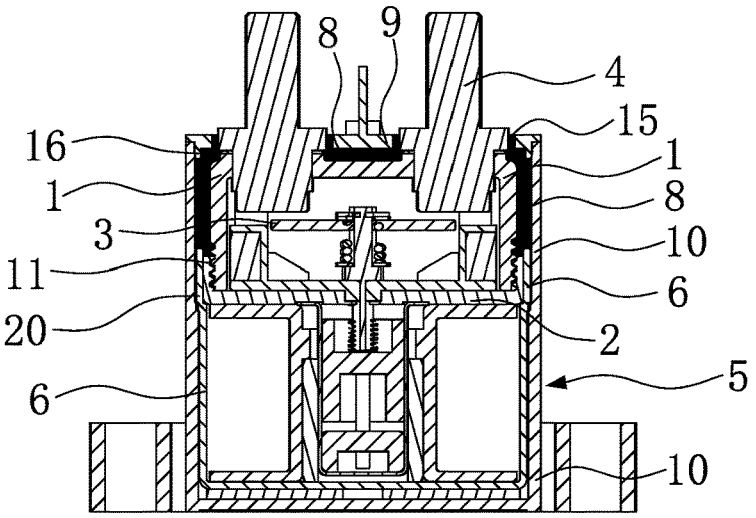
FIG. 1 is a schematic sectional view of the present invention after the adhesive pouring process.

As shown in FIG. 1, FIG. 3, FIG. 4 and FIG. 5, the present invention provides a sealed HVDC relay, comprising an insulating hood 1 and a yoke plate 2; the insulating hood 1 has an overturned cup structure, an outer edge of the yoke plate 2 is extended upward to form a cylindrical fixing portion 11, and a lower end of the insulating hood 1 and the fixing portion 11 of the yoke plate 2 are fitted and fixed with each other by threads; the insulating hood 1 and the yoke plate 2 are fixed by threads, and a chamber for accommodating a moving contact assembly and a stationary contact assembly is formed by the insulating hood 1 and the yoke plate 2; and the portion fitted by threads between the lower end of the insulating hood and the fixing portion is sealed by pouring a sealing adhesive 8.

An internal thread portion 12 is formed at the fixing portion 11, and an external thread portion 13 fitted with the internal thread portion 12 is formed at a lower end of the insulating hood 1. A chamber for accommodating a moving contact assembly and a stationary assembly is formed by fixing the insulating hood 1 and the yoke plate 2 by threads; the moving contact assembly comprises a moving reed 3 and moving contacts; and the stationary contact assembly comprises stationary contacts and a leading-out end 4 which is fixed with the top of the insulating hood 1. A leading-out end 4 comprises an upper section, a middle section and a lower section. Stationary contacts are fixed with the lower section of the leading-out end, external threads are formed on the middle section of the leading-out end, and a second threaded through hole 44 fitted with the middle section of the leading-out end is formed on the insulating hood 1. The threaded structure of the second threaded through hole of the insulating hood 1 and the external thread portion 12 at the lower end of the insulating hood 1 are integrally molded when the insulating hood is sintered, and the insulating hood is made of ceramics. The second threaded through hole and the external thread portion of the insulating hood are formed as follows: inserting a bolt before a ceramic body of the insulating hood is made, obtaining the ceramic body with an external thread portion by molding; unscrewing the bolt after the body is formed; and sintering the ceramic body to obtain an insulating hood having a second threaded through hole and an external thread portion. Such a method has simpler manufacturing process and lower cost than machining threads on a ceramic cover, and also has lower cost than brazing the leading-out end and the insulating hood. Wherein, as the leading-out end and the insulating hood are fixed by threaded connection, the connection strength between the leading-out end and the insulating hood can be enhanced; and the thickness of the insulating hood made of ceramics can be reduced while ensuring the connection strength between the leading-out end and the insulating hood, and the manufacturing cost of the present invention is thus reduced.

The external thread portion 13 has a thread height greater than that of the internal thread portion 12; the insulating hood 1 and the fixing portion 11 of the yoke plate 2 are fitted by threads, so that external threads are exposed from the insulating hood 1 at a position corresponding to an upper side of the fixing portion 11; and a first adhesive pouring cavity 17 is formed between a wall of the yoke cup and the external threads exposed from the insulating hood. A magnetic circuit system 5 is provided below the yoke plate 2, and the magnetic circuit system 5 is arranged inside a cylindrical yoke cup 6 having a wall extended upward above an upper end surface of the fixing portion 11 of the yoke plate 2; the insulating hood 1 is fixed with the yoke plate 2 by threads, and a lower end surface of the insulating hood 1 is resisted against an upper end surface of the yoke plate 2.

As shown in FIG. 1, FIG. 2, FIG. 3 and FIG. 7, the insulating hood 1, the yoke plate 2 and the yoke cup 6 are all arranged inside a shell 10; the shell 10 has a cylindrical structure; and the top of the shell 10 is fixed with an upper cover 9 which is located above the insulating hood 1. An upper section of the leading-out end 4 passes through the insulating hood 1 and the upper cover 9 to be extended to an outer side of the upper cover 9; and a first through hole 14 for the upper section of the leading-out end 4 to pass through is formed on the upper cover 9. An adhesive pouring hole 15 is formed on the upper cover 9; a second adhesive pouring cavity 18 is formed between the upper cover 9 and the insulating hood 1; the first adhesive pouring cavity 17 and the second adhesive pouring cavity 18 are communicated; and the sealing adhesive 8 is filled inside both the first adhesive pouring cavity 17 and the second adhesive pouring cavity 18.

Figure 2:
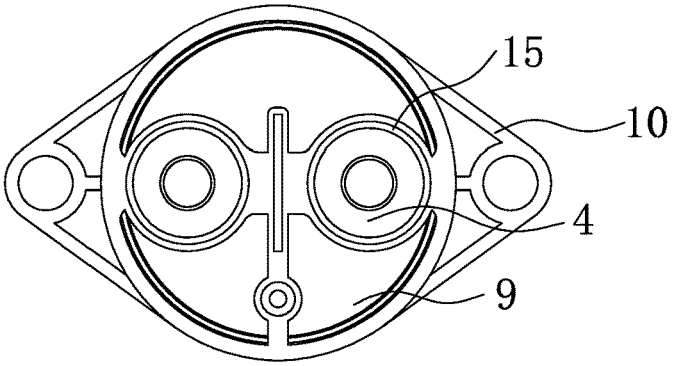
FIG. 2 is a top view of the present invention.
Figure 3:
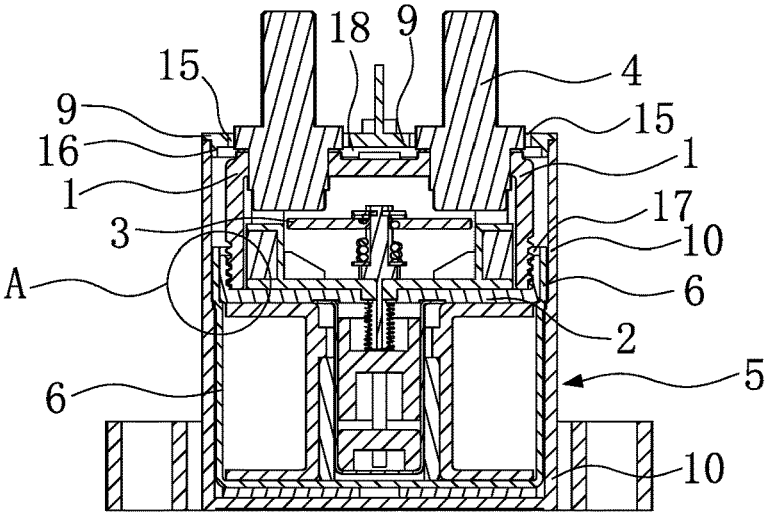
FIG. 3 is a schematic sectional view of the present invention before the adhesive pouring process.
Figure 4:
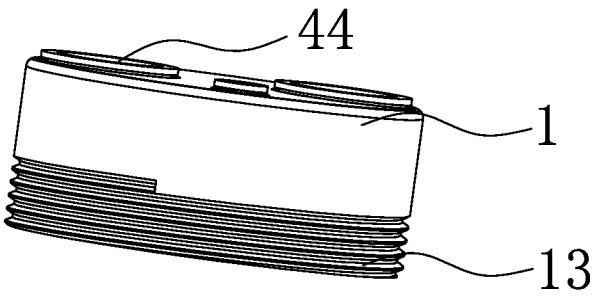
FIG. 4 is a schematic structure diagram of an insulating hood according to the present invention.
Figure 5:
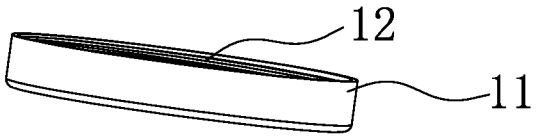
FIG. 5 is a schematic structure diagram of a yoke plate according to the present invention.
Figure 6:
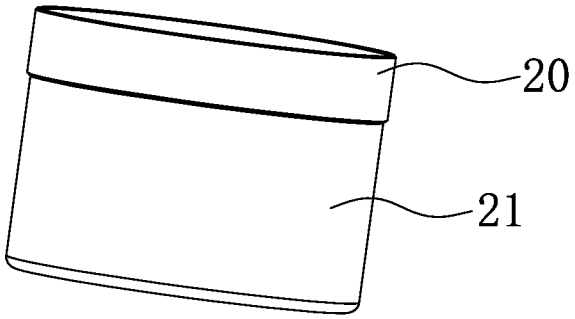
FIG. 6 is a schematic structure diagram of a yoke cup according to the present invention.

As shown in FIG. 1, FIG. 2 and FIG. 3, a diameter of the first through hole 14 of the upper cover 9 is greater than an external diameter of the upper section of the leading-out end 4; and a gap between the upper section of the leading-out end 4 and the upper cover 9 is the adhesive pouring hole 15. The adhesive is filled from the adhesive filling hole 15; the sealing adhesive flows along the gap between the shell 10 and the insulating hood 1 to the first adhesive pouring cavity 17 and enters the gap between the external thread portion and the internal thread portion (the gap between the insulating hood and the fixing portion of the yoke plate) along the external threads exposed from the insulating hood, so as to seal the portion fitted by threads between the insulating hood and the yoke plate; gaps between the first adhesive pouring cavity 17, the shell and the insulating hood are successively filled by the sealing adhesive; then the sealing adhesive is filled into the second adhesive pouring cavity 18 so as to seal the position where the leading-out end and an outer surface of the insulating hood contact; when the second adhesive pouring cavity 18 is filled with the sealing adhesive, the sealing adhesive overflows the adhesive pouring hole or the sealing adhesive is located inside the adhesive pouring hole, and the whole adhesive pouring operation is thus completed.

As shown in FIG. 1, FIG. 3, FIG. 6 and FIG. 8, the wall of the yoke cup 6 comprises an upper cup wall portion 20 and a lower cup wall portion 21; an external diameter of the upper cup wall portion 20 is greater than that of the lower cup wall portion 21; a lip structure 22 is formed on a wall of the shell 10; and a lower edge of the upper cup wall portion 20 is resisted against the lip structure 22. An internal diameter of the upper cup wall portion 20 of the yoke cup 6 is greater than that of the lower cup wall portion 21; and the lower end surface of the yoke plate 2 is resisted against the upper edge of the lower cup wall portion 21. This arrangement can prevent the sealing adhesive from entering the magnetic circuit system and reduce loss from a sealing adhesive pouring process.

Figure 7:
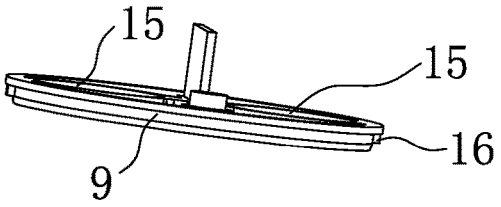
FIG. 7 is a schematic structure diagram of an upper cover according to the present invention.
Figure 8:
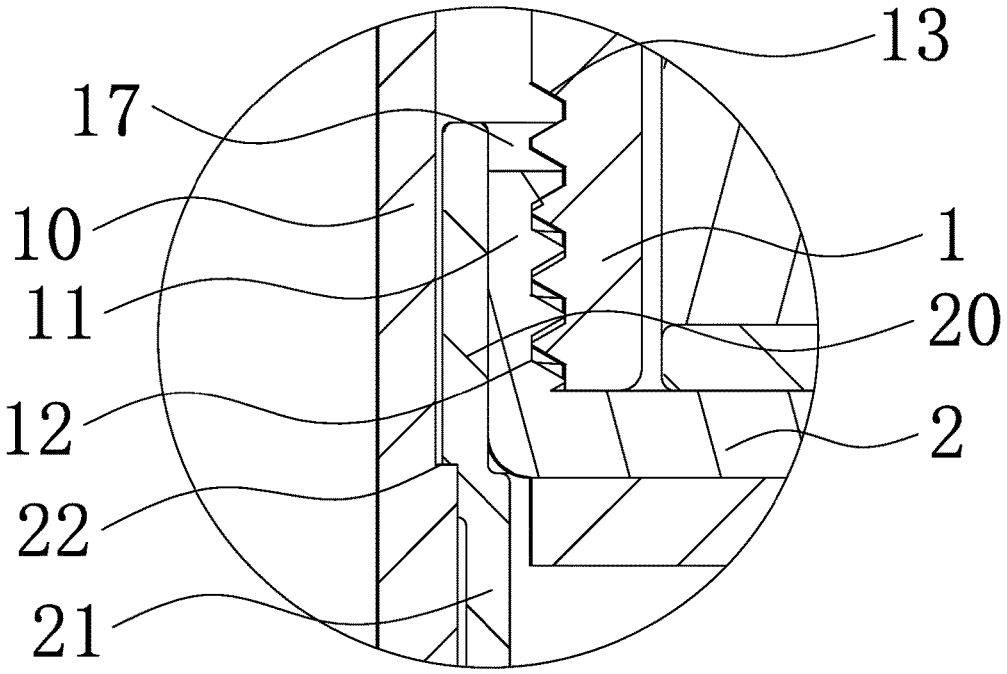
FIG. 8 is an enlarged view of part A of FIG. 3.

As shown in FIG. 1, FIG. 3 and FIG. 7, two positioning bosses 16 extending downward are formed on the lower end surface of the upper cover 9; the two positioning bosses 16 are arranged on two opposite sides of the lower end surface of the upper cover 9; and the upper cover 9 and the shell 10 are fitted, so that the positioning bosses 16 are resisted against an inner side of the wall of the shell 10. This arrangement facilitates the positioning and fixing of the upper cover 9 and the shell 10.

In the present invention, with the insulating hood made of ceramics, the stiffness of the relay structure of the present invention is promised. The absence of a brazing process makes the relay of the present invention short in manufacturing period and low in cost. With regard to the present invention, the sealing performance of the relay is promised by adhesive pouring, and a service voltage of the relay can be increased. In this way, the voltage of the relay of the present invention can reach 1000 V, thus improving the application performance of the present invention.

The invention claimed is:

1. A sealed high voltage direct current (HVDC) relay, comprising an insulating hood and a yoke plate which is extended upward to form a cylindrical fixing portion; the insulating hood has an overturned cup structure; a chamber for accommodating moving contacts and stationary contacts is formed by the yoke plate and the insulating hood together; a lower end of the insulating hood and the fixing portion of the yoke plate are fitted with each other by threads; and the portion fitted by threads between the lower end of the insulating hood and the fixing portion is sealed by adhesive pouring, characterized in that an external thread portion is formed at a lower end of the insulating hood, and an internal thread portion is formed at the fixing portion; the internal thread portion has a thread height less than that of the external thread portion; the insulating hood and the fixing portion of the yoke plate are fitted by threads so that external threads are exposed from the insulating hood at a position corresponding to the upper side of the fixing portion.

2. The sealed HVDC relay according to claim 1, characterized in that a magnetic circuit system is provided below the yoke plate, and the magnetic circuit system is arranged inside a cylindrical yoke cup having a wall extended upward above an upper end surface of the fixing portion of the yoke plate; a lower end surface of the insulating hood is resisted against the yoke plate; and a first adhesive pouring cavity is formed between the wall of the yoke cup and the insulating hood, and a sealing adhesive is filled inside the first adhesive pouring cavity.

3. A sealed high voltage direct current (HVDC) relay, comprising an insulating hood and a yoke plate which is extended upward to form a cylindrical fixing portion; the insulating hood has an overturned cup structure; a chamber for accommodating moving contacts and stationary contacts is formed by the yoke plate and the insulating hood together; a lower end of the insulating hood and the fixing portion of the yoke plate are fitted with each other by threads; and the portion fitted by threads between the lower end of the insulating hood and the fixing portion is sealed by adhesive pouring, characterized in that an external thread portion is formed at a lower end of the insulating hood, and an internal thread portion is formed at the fixing portion; a magnetic circuit system is provided below the yoke plate, and the magnetic circuit system is arranged inside a cylindrical yoke cup having a wall extended upward above an upper end surface of the fixing portion of the yoke plate; a lower end surface of the insulating hood is resisted against the yoke plate; and a first adhesive pouring cavity is formed between the wall of the yoke cup and the insulating hood, and a sealing adhesive is filled inside the first adhesive pouring cavity.

4. The sealed HVDC relay according to claim 3, characterized in that the insulating hood, the yoke plate and the yoke cup are all arranged inside a shell; the shell has a cylindrical structure; the top of the shell is fixed with an upper cover which is located above the insulating hood; a leading-out end comprises an upper section, a middle section and a lower section; stationary contacts are fixed with the lower section of the leading-out end, the middle section of the leading-out end is fixed with the insulating hood, and the upper section of the leading-out end passes through the insulating hood and the upper cover so as to be extended to an outer side of the upper cover; a first through hole for an upper end of the leading-out end to pass through is formed on the upper cover; an adhesive pouring hole is formed on the upper cover; and a second adhesive pouring cavity is formed between the upper cover and the insulating hood, and an sealing adhesive is filled inside the second adhesive pouring cavity.

5. The sealed HVDC relay according to claim 4, characterized in that the first adhesive pouring cavity and the second adhesive pouring cavity are communicated.

6. The sealed HVDC relay according to claim 4, characterized in that a diameter of the first through hole is greater than an external diameter of the leading-out end; and a gap between the upper section of the leading-out end and the upper cover is the adhesive pouring hole.

7. The sealed HVDC relay according to claim 4, characterized in that the wall of the yoke cup comprises an upper cup wall portion and a lower cup wall portion; an external diameter of the upper cup wall portion is greater than that of the lower cup wall portion; a lip structure is formed on a wall of the shell; and a lower edge of the upper cup wall portion is resisted against the lip structure.

8. The sealed HVDC relay according to claim 7, characterized in that an internal diameter of the upper cup wall portion of the yoke cup is greater than that of the lower cup wall portion; and the lower end surface of the yoke plate is resisted against the upper edge of the lower cup wall portion.

9. The sealed HVDC relay according to claim 4, characterized in that a plurality of positioning bosses extending downward are formed at an outer edge of the lower end surface of the upper cover; the plurality of positioning bosses are evenly arranged at intervals in an annular shape; and the positioning bosses are resisted against an inner side of the wall of the shell.

10. The sealed HVDC relay according to claim 4, characterized in that the insulating hood is made of ceramics; there are external threads on the lower side of the middle section of the leading-out end; a first threaded through hole fitted with the middle section of the leading-out end is formed on the top of the insulating hood; the first threaded through hole of the insulating hood and the external threads of the external thread portion are integrally shaped when the insulating hood is sintered.

* * * * *